United States Patent [19]

Hoffman

[11] Patent Number: 4,924,636

[45] Date of Patent: May 15, 1990

[54] ORBITAL RUBBING MACHINE WITH IMPROVED SPINDLE LOCKING MEMBER

[75] Inventor: Roger T. Hoffman, Monroe Center, Ill.

[73] Assignee: National-Detroit, Inc., Rockford, Ill.

[21] Appl. No.: 424,504

[22] Filed: Oct. 20, 1989

[51] Int. Cl.[5] ..... B24B 23/02

[52] U.S. Cl. ..... 51/170 MT; 15/97 B; 15/180

[58] Field of Search ..... 51/170 T, 170 MT, 170 R, 51/170 PT, 174, 176, 177; 15/28, 49, 97, 180

[56] References Cited

U.S. PATENT DOCUMENTS 2,794,303 6/1957 Wickes ..... 51/170 MT

*Primary Examiner*—Roscoe V. Parker

*Attorney, Agent, or Firm*—Leydig, Voit & Mayer

[57] ABSTRACT

A locking member is formed with a circular plate and an upstanding rim and is adapted to be pivoted between locked and unlocked positions beneath the head of an orbital sander. When in its locked position, the locking member holds the spindle of the sander against turning and permits the sanding pad to be unscrewed from the spindle. The plate of the locking member includes a dimple which engages the head and causes the locking member to rotate concentrically with the head when the locking member is in its normal, unlocked position. The rim of the locking member performs a fail-safe holding function in the event the dimple fails and also prevents the locking member from being improperly installed in an upside down position.

8 Claims, 1 Drawing Sheet

ORBITAL RUBBING MACHINE WITH IMPROVED SPINDLE LOCKING MEMBER

BACKGROUND OF THE INVENTION

This invention relates to a rubbing machine such as a portable sander of the type used by automotive body shops to prepare body parts for painting.

A popular sander of this type includes a power-rotated head which rotatably supports an eccentric spindle. A rubbing pad is clamped to the end of the spindle by a screw or the like and carries an abrasive disc. When the head is rotated, the spindle turns within the head and causes the pad and the abrasive disc to move with an orbital action.

In order to replace the rubbing pad, the screw is loosened and the pad is detached from the spindle. To enable loosening of the screw, the head carries a locking member which may be selectively moved between locked and unlocked positions. When the locking member is in its locked position, it engages the spindle and prevents the spindle from turning relative to the head so that the screw may be unthreaded from the spindle.

With prior sanders of this type, the locking member is in the form of a ring-like plate having upstanding dimples which are adapted to engage the head in order to confine the locking member radially relative to the head. The plate normally is offcenter relative to the head and tends to unbalance the sander. Moreover, the offcenter plate tends to hit obstructions and interfere with the sanding operation.

In some cases, the locking member of the prior sander may be improperly assembled in an upside down position and, in such an instance, the dimples are ineffective to radially retain the locking member. The unretained locking-member may tear loose from the head and cause personal injury.

SUMMARY OF THE INVENTION

One aim of the present invention is to provide a new and improved rubbing machine of the above general type in which the locking member not only is more safely retained in a radial direction but also is prevented from being improperly installed in a position which defeats the radial retention.

A more detailed object of the invention is to achieve the foregoing by providing a locking member in the form of a cup having an upstanding rim which encircles the head to provide radial retention and which serves as a guard against upside down assembly of the locking member.

An important object of the invention is to provide a locking member which, when in its normal unlocked position, rotates concentrically with the head in order to promote smooth operation of the sander and reduce the danger of the locking member striking an obstruction.

The invention also resides in the use of the locking member to prevent the bearing of the spindle from flying out of the head in the event the bearing becomes loose or falls apart.

These and other objects and advantages of the invention will become more apparent from the following detailed description when taken in conjunction with the accompanying drawings.

DETAILED DESCRIPTION OF THE PREFERRED EMBODIMENT

Figure 1:
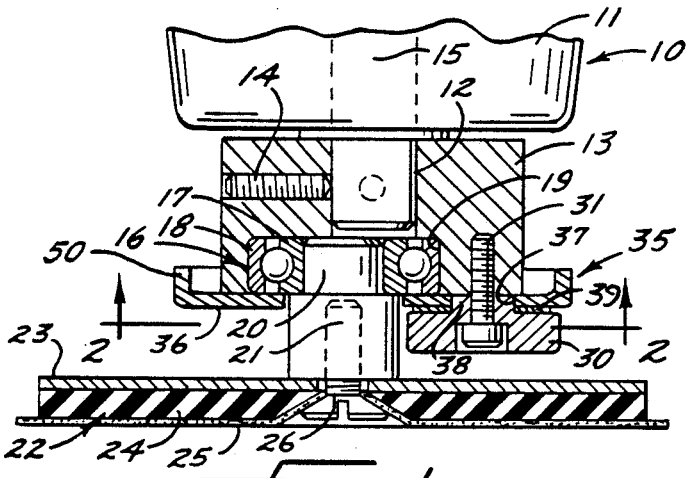
FIG. 1 is a side elevational view of a new and improved rubbing machine incorporating the unique features of the present invention, certain parts being broken away and shown in section.

For purposes of illustration, the invention has been shown in the drawings as incorporated in a rubbing machine and specifically in a portable sander 10 for use in smoothing automobile body parts and the like. A sander of this general type is disclosed in Champayne U.S. Pat. No. 3,826,045.

Briefly, the sander 10 includes a housing 11 which rotatably supports a shaft 12 adapted to be driven by an air motor (not shown). A head 13 in the form of a generally cylindrical block is secured to the lower end portion of the shaft by a set screw 14 and is adapted to rotate counterclockwise (FIG. 2) with the shaft about the axis 15 thereof.

Figure 6:
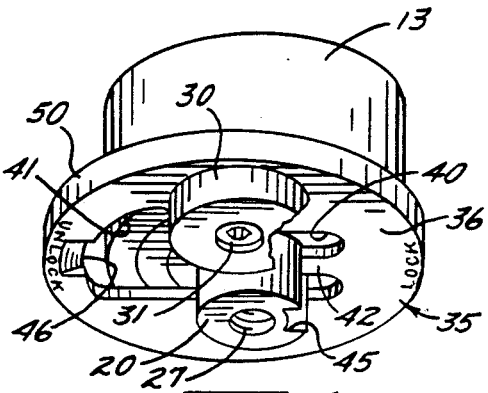
FIG. 6 is a perspective view of the head and the locking member.

A ball bearing 16 with inner and outer races 17 and 18 is supported within a bore 19 in the lower end portion of the head 13 and journals a spindle 20 for rotation about an axis 21 which extends parallel to and is offset radially from the axis 15 of the shaft 12. The spindle is pressed into the inner race 17 of the bearing 16. Attached to the lower end of the spindle is a sanding pad 22 consisting of a circular metal plate 23 and an elastomeric disc 24, there being a sheet 25 of abrading paper such as sandpaper secured to the disc. The pad 22 is attached to the spindle 20 by a screw 26 which is threaded into a tapped bore 27 (FIGS. 4 and 6) in the spindle.

When the shaft 12 is rotated, the pad 22 orbits around the axis 15 of the shaft and, at the same time, spins about the axis 21 of the spindle 20. A circular counterweight 30 is secured to the lower end of the head 13 by a screw 31 and is offset from the spindle 20 180 degrees about the axis 15 in order to counterbalance the force resulting from the eccentric spindle and pad.

To replace the rubbing pad 22, the screw 26 is loosened and removed in order to enable the pad to be detached from the spindle 20. The screw then is tightened when the pad is re-installed. In order to loosen and tighten the screw, it is necessary to prevent the spindle from rotating in the bearing 16 about the axis 21. For this purpose, the sander is equipped with a locking member 35 which normally permits free rotation of the spindle but which may be selectively moved to a position locking the spindle to the head 13.

The present invention contemplates the provision of a new and improved locking member 35 which normally rotates concentrically with the head 13 in order to avoid unbalancing the sander 10 and and to reduce the likelihood of the locking member hitting an obstruction. When compared to prior devices, the locking member 35 is more safely coupled to the head 13 and can be assembled to the head only when oriented in a proper and safe position. Thus, there is less danger of the locking member tearing away from the head and causing personal injury.

More specifically, the locking member 35 is in the shape of a cup having a circular lower plate 36 made of metal and formed with a circular hole 37 (FIG. 1). The latter receives a reduced-diameter shank 38 formed integrally with the upper end of the counterweight 30 and coacts with the shank to mount the plate 36 for pivoting about the axis of the shank. A spring washer 39 is sandwiched between the lower end of the plate 36 and the upper end of the counterweight 30. When the screw 31 is tightened, the counterweight acts through the spring washer to clamp the plate to the head 13 while allowing the plate to pivot about the shank 38. The washer creates frictional drag to resist free pivoting of the plate.

Formed in the plate 36 and receiving the spindle 15 is a generally rectangular slot 40 (FIG. 2) having an enlarged radiused portion 41 at one end to facilitate installation of the plate on the spindle 15. A tongue 42 is defined at the other end of the slot.

Figure 2:
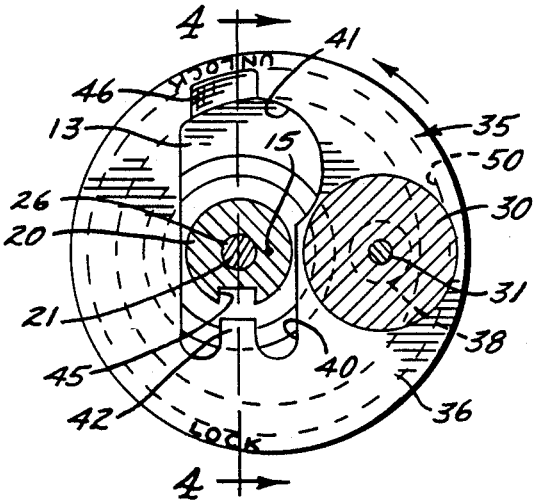
FIG. 2 is a cross-section taken substantially along the line 2—2 of FIG. 1 and shows the locking member in its normal, unlocked position.
Figure 3:
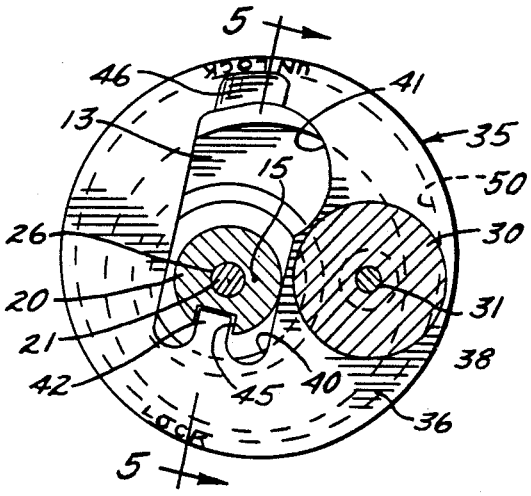
FIG. 3 is a view similar to FIG. 2 but shows the locking member in its locked position.
Figure 4:
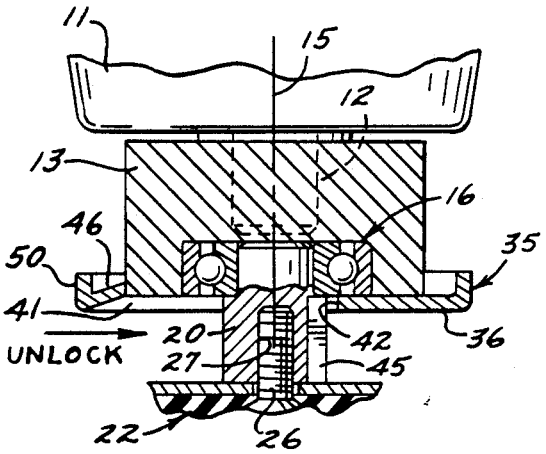
FIG. 4 is a fragmentary cross-section taken substantially along the line 4—4 of FIG. 2.
Figure 5:
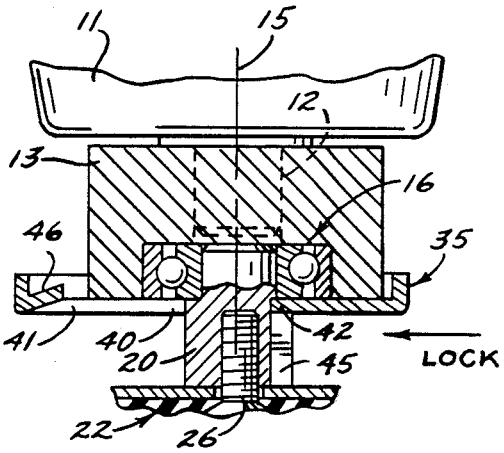
FIG. 5 is a fragmentary cross-section taken substantially along the line 5—5 of FIG. 3.

Normally, the locking member 35 is located in an unlocked position shown in FIGS. 2 and 4 and, when the locking member is so positioned, the tongue 42 is spaced from the spindle 15 to allow free turning thereof. By pivoting the locking member 35 clockwise about the shank 38, the locking member is moved to a locked position (FIGS. 3 and 5) in which the tongue 42 fits into a keyway 45 formed along the spindle 20. As a result, the tongue prevents the spindle from turning about the axis 21 and thus the screw 26 may be turned relative to the spindle for purposes of removing or installing the pad 22.

When the shaft 12 is rotated counterclockwise (FIG. 2), a centrifugal force tends to pivot the locking member 35 counterclockwise about the shank 38.

Pursuant to the invention, the locking member is held concentric with the head 13 when the locking member is in its normal, unlocked position. For this purpose, an abutment in the form of a dimple 46 (FIGS. 2 and 4) is deformed upwardly from the plate 36 adjacent the edge of the radiused portion 41 of the slot 40, the dimple being spaced approximately 90 degrees from the counterweight 30 and 180 degrees from the tongue 42. When the plate 36 of the locking member 35 is concentric with the head 13, the edge of the dimple 46 engages the outer periphery of the head as shown in FIGS. 2 and 4. Such engagement limits counterclockwise swinging of the plate 36 about the shank 38 and keeps the plate concentric with the head 13 during normal operation of the sander 10 when the locking member 35 is in its unlocked position. As a result of being concentric with the head, the locking member is less likely to hit an obstruction and, in addition, the sander 10 operates smoother and with better balance.

Further in keeping with the invention, an annular rim 50 is formed integrally with and projects upwardly from the periphery of the plate and axially overlaps the head 13. If the dimple 46 is sheared away or deformed downwardly and loses its holding action, the rim 50 engages the head 13 and prevents the locking member 35 from swinging counterclockwise about the shank 38 sufficiently far as to bring the edge of the radiused portion 41 of the slot 40 into engagement with the spindle 20. Thus, the spindle 20 is prevented from cutting through the plate 36 and, at the same time, the plate is prevented from cutting into the spindle. This reduces the danger of either the plate or the spindle flying loose.

The rim 50 performs another function in that it coacts with the counterwei9ht 30 to prevent the lockin9 member 35 from being improperly installed in an inverted position in which the dimple 46 and the rim 50 project downwardly from the plate 36. If the plate is assembled upside down, the holding action of the dimple and the safety function of the rim are defeated. In the present instance, such upside down assembly is rendered impossible by making the inside diameter of the rim 50 of such dimenstion that the rim radially overlaps the counterweight 30. If one inadvertently attempts to assemble the locking member 35 upside down, the rim hits and interferes with the counterweight and defeats the assembly.

The rim 50 also presents a relatively wide and smooth surface by which the locking member 35 may be pushed in order to pivot the locking member between its locked and unlocked positions. Thus, such pivoting may be accomplished without the locking member digging into the operator's hand and fingers.

The plate 36 is configured so as to prevent the inner race 17 of the bearing 16 from flying out of the bore 19 if the bearing should disintegrate. To this end, the width of the slot 40 is somewhat less than the outer diameter of the inner race 17 (see FIG. 1). If the bearing 16 fails, the underlying plate 36 captivates the inner race 17 in the bore 19 and prevents the inner race, the spindle 20 and the pad 22 from flying away from the sander 10.

From the foregoing, it will be apparent that the present invention brings to the art a new and improved sander 10 in which the locking member 35 runs concentrically with the head 13 when the locking member is in its normal, unlocked position. The upstanding rim 50 of the locking member serves as a fail-safe retention element and also prevents improper assembly of the locking member.

I claim:

1. A rubbing machine comprising a generally circular head having a lower end, mechanism for rotating said head about a first upright axis which coincides with the axis of the head, a spindle extending downwardly from said head and supported by said head to rotate relative to said head about a second upright axis extending parallel to and offset radially from said first axis, a rubbing pad, a threaded fastener connecting said pad to the lower end of said spindle and adapted to be turned and loosened to permit removal of said pad from said spindle, and means for selectively locking said spindle against rotation relative to said head in order to permit turning and loosening of said fastener, said means comprising a generally circular plate underlying the lower end of said head and having an opening receiving said spindle, means clamping said plate to said head while permitting said plate to be selectively moved edgewise relative to said head between locked and unlocked positions, means on said plate and engageable with said spindle to prevent said spindle from rotating relative to said head when said plate is in said locked position, and abutment means on said plate and engageable with said head to keep said plate concentric with said first axis when said plate is in said unlocked position.

2. A rubbing machine as defined in claim 1 in which said abutment means comprise a dimple deformed upwardly from said plate adjacent the edge of said opening and engageable with the outer periphery of said head to keep said plate concentric with said first axis when said plate is in said unlocked position.

3. A rubbing machine as defined in claim 2 further including an annular rim formed integrally with and projecting upwardly from the outer periphery of said plate, said rim normally being spaced radially outwardly from the outer periphery of said head but being engageable therewith upon failure of said dimple thereby to restrict edgewise movement of said plate.

4. A rubbing machine as defined in claim 3 further including means below said plate and engageable with said rim to prevent said plate from being clamped to said head in an inverted position in which said rim and said dimple project downwardly from said plate.

5. A rubbing machine as defined in claim 1 further including a bearing having inner and outer races and supporting said spindle for rotation in said head, said bearing being disposed in a bore in said head, said opening in said plate being sized and shaped so as to cause said plate to captivate the inner race of said bearing in said bore.

6. A rubbing machine comprising a head having a lower end, mechanism for rotating said head about a first upright axis, a spindle extending downwardly from said head and supported by said head to rotate relative to said head about a second upright axis extending parallel to and offset radially from said first axis, a rubbing pad, a threaded fastener connecting said pad to the lower end of said spindle and adapted to be turned and loosened to permit removal of said pad from said spindle, and means for selectively locking said spindle against rotation relative to said head in order to permit turning and loosening of said fastener, said means comprising a plate underlying the lower end of said head and having an opening receiving said spindle, means clamping said plate to said head while permitting said plate to be selectively moved edgewise relative to said head between locked and unlocked positions, means on said plate and engageable with said spindle to prevent said spindle from rotating relative to said head when said plate is in said locked position, rim means projecting upwardly from the periphery of said plate and encircling said head to restrict edgewise movement of said plate, and a member engageable with said rim means for preventing said plate from being clamped to said head in an inverted position in which said rim means project downwardly from said plate.

7. A rubbing machine as defined in claim 6 in which said member comprises a counterweight connected to said head and located beneath said plate, said counterweight projecting radially outwardly beyond said rim.

8. A rubbing machine as defined in claim 6 further including abutment means on said plate and engageable with said head to keep said plate concentric with said first axis when said plate is in said unlocked position.

* * * * *